US005678166A

United States Patent [19]

Piehler et al.

[11] Patent Number: 5,678,166

[45] Date of Patent: *Oct. 14, 1997

[54] HOT TRIAXIAL COMPACTION

[75] Inventors: Henry R. Piehler, 4367 Schenley Farms Ter., Pittsburgh, Pa. 15213; Daniel M. Watkins, Pittsburgh, Pa.

[73] Assignee: Henry R. Piehler, Pittsburgh, Pa.

[ * ] Notice: The term of this patent shall not extend beyond the expiration date of Pat. No. 5,134,260.

[21] Appl. No.: 509,610

[22] Filed: Jul. 31, 1995

Related U.S. Application Data

[63] Continuation of Ser. No. 230,631, Apr. 21, 1994, abandoned, which is a continuation of Ser. No. 535,420, Jun. 8, 1990, abandoned.

[51] Int. Cl.[6] ..... B22F 3/12

[52] U.S. Cl. ..... 419/38; 419/42; 419/48

[58] Field of Search ..... 419/38, 42, 48

[56] References Cited

U.S. PATENT DOCUMENTS

| | | | |
|---|---|---|---|
| 3,295,844 | 1/1967 | Neeley et al. | 425/78 |
| 3,567,896 | 3/1971 | Chang | 425/78 |
| 3,830,607 | 8/1974 | Baxendale et al. | 425/78 |
| 4,151,400 | 4/1979 | Smith, Jr. et al. | 219/400 |
| 4,599,215 | 7/1986 | Smarsly et al. | 419/42 |
| 4,629,412 | 12/1986 | Inoue et al. | 425/405 |
| 4,656,002 | 4/1987 | Lizenby et al. | 425/405.2 |
| 4,708,627 | 11/1987 | Asari et al. | 425/405 |
| 4,747,999 | 5/1988 | Hasselström | 419/49 |
| 4,983,112 | 1/1991 | Uehara et al. | 425/405.2 |
| 5,134,260 | 7/1992 | Piehler et al. | 219/10.41 |
| 5,154,882 | 10/1992 | Zick | 419/49 |

OTHER PUBLICATIONS

R.M. German, Powder Metallurgy Science, Metal Powder Industries Federation, U.S.A., 1984.

P.C. Panda, J. Lagraff and R. Raj, Acta Metall. 36/8 (1988) 1929–1939.

*Primary Examiner*—Charles T. Jordan
*Assistant Examiner*—Daniel Jenkins
*Attorney, Agent, or Firm*—Ansel M. Schwartz

[57] ABSTRACT

The present invention pertains to an apparatus to hot triaxially compact powder. The apparatus includes a device for hydrostatically stressing the powder. The apparatus also includes a device for applying a shear stress to the powder simultaneously with the hydrostatic stress. Additionally, there is a device for heating the powder while the powder is hydrostatically in shear stress. The presence of the shear stress during the compaction of the powder has three primary effects. It can increase the final density and the densification rate of the compacted powder. It can cause microstructural changes in the compacted powder, and it can disrupt heterogeneities.

3 Claims, 5 Drawing Sheets

HOT TRIAXIAL COMPACTION

This is a continuation of application Ser. No. 08/230,631 filed on Apr. 21, 1994, now abandoned, which is a continuation of application Ser. No. 07/535,420 filed on Jun. 8, 1990, now abandoned.

FIELD OF THE INVENTION

The present invention is related to the compaction of powders. More specifically, the present invention relates to the compaction of powders in the presence of shear and hydrostatic stress as well as elevated temperature.

BACKGROUND OF THE INVENTION

Interest in the effect of shear on powder compaction is motivated by the need for ceramics, composites, rapidly solidified metals, intermetallics and other advanced materials where powder metallurgy is an attractive, or possibly the only, processing route. In the most common metallurgy consolidation techniques shear is absent (sintering, hot isostatic pressing) or is difficult to characterize or control (hot pressing, powder extrusion). Some existing processes (Ceracon process, C. G. Levi, R. Mehrabian, B. Oslin, R. L. Anderson, and S. M. L. Sastry, J. Mater. Shaping Technol., vol. 6, no. 2, 125–132 (1988); Combined die forging, W. Smarsly, W. Bunk, R. Kopp, in Proc. 5th Int. Conf. on Titanium, Munich (1984); Rapid omnidirectional compaction, J. R. Lizenby, W. J. Rozmus, J. L. Barnard, and C. Kelto, A., in Metal Powder Report Conference, Zurich (1980) can impart shear stresses during compaction, but characterization and control of these stresses is also limited.

Evidence that shear stresses enhance the consolidation of metallic and ceramic compacts is found in several key works and a large collection of "indications" from studies focused in other directions. For instance, geological and geotechnical materials are often porous and a wealth of literature exists for hot triaxial testing of these materials under conditions of a compressive volumetric strain. However, it appears that the dilitant rather than the compressive behavior has been of primary interest in these geological studies. The work on void growth in creep is also relevant to this study.

Enhanced consolidation of the powders in the plastic regime has been well documented. R. M. Koerner, in *Powder Metallurgy Processing: New Techniques and Applications* (edited by H. A. Kuhn and A. Lawley), Academic Press, NY (1978) triaxially compacted iron powders using an axisymmetric stress state at room temperature. R. N. Schock, A. B. Abey, and A. Duba, J. Appl. Phys. vol. 47, 53–63 (1976) performed hydrostatic and triaxial compaction experiments on aluminum preforms at room temperature containing 23.6% initial porosity. These experiments show that shear enhanced compaction is most evident at higher confining pressures (>0.5 GPa) and higher density. In fact, in the hydrostatic case, the volume strain appears to reach an asymptotically limiting value with increasing pressure, indicating that, in addition to the increase in densification rate, the absolute density attainable may be increased by shear.

Because of experimental difficulty, a much smaller body of research exists for elevated temperature compaction. Hot pressing studies are common but the inhomogeneous stress state induced by wall friction and the difficulty in determining the lateral force without having a developed flow model, a priori, makes analysis extremely difficult. Another experimental technique, sinterforging, involves uniaxial pressing (S only) on a sintering compact. In experiments on sinterforging of alumina, K. R. Venkatachari and R. Raj, J. Am. Ceram. Soc. vol. 69, no. 6, 499–506 (1986); and superalloy powders, P. C. Panda, J. LaGraff, and R. Raj, Cornell University Materials Science Report, Jun. 15, 1987, higher densities were achieved more rapidly with the addition of S, where S is the axial stress. Sinterforging provides for the application of known hydrostatic and shear stresses, unlike hot pressing where T is unknown and may tend toward S as relative density, D, approaches one, D>1. For sinterforging T=0, so the stress state is described by:

$$\sigma_m = S/3 \quad (1)$$

$$\bar{\sigma} = S \quad (2)$$

Thus, in sinterforging the shear and hydrostatic stress components are coupled and not independently variable. If plotted in $\sigma_m$–$\bar{\sigma}$ space, the sinterforging data all fall on the single line: $3\sigma_m = \bar{\sigma}$.

Equipment for room temperature triaxial consolidation of powder/metallurgy materials is described by R. M. Koerner, in *Powder Metallurgy Processing: New Techniques and Applications* (edited by H. A. Kuhn and A. Lawley), Academic Press, NY (1978) and in detail by W. C. P. M. Meerman and A. C. Knaapen, Powder Technology, vol. 22, 271–278 (1979). Extension to high temperature studies involves considerable modification because of space limitations, electrical feed-throughs, and thermocouple feed-throughs. The furnace design for cold wall vessels is also critical in that conductive and convective heat flow must be limited yet force must be transmitted to the specimen by load bearing members, see P. Malbunot, P. A. Meunier, and D. Vidal, Chem. Eng. World vol. 7, 53–58 (1972), M. S. Patterson, Int. J. Rock. Mech. vol. 7, 517–526 (1970). Considerable expertise does exist for designing the smaller furnaces used in creep testing of rocks (specimen size 10 mm diameter). The basic design philosophy for pressure vessels and furnaces used in geological testing is described in M. S. Patterson, Int. J. Rock. Mech. vol. 7, 517–526 (1970).

In the only cold triaxial processing of powders, K. H. J. Buschow, P. A. Naastepad, and F. F. Westendorp, J. Applied Phys., vol. 40, no. 10, 4029–4032 (1969) consolidated $SmCo_5$ powder in a device capable of processing permanent magnet powders at 2.0 GPa confining pressure. At $\sigma_m$=3.2 GPa and $\bar{\sigma}$=3.6 GPa, the compact density reached 97% of theoretical density (at which time fracture occurs in the constant strain rate test) whereas in a purely hydrostatic test, $\sigma_m$=4.0 GPa, the maximum density achieved is only 86%.

With respect to the present invention, well controlled shear and hydrostatic stresses are applied to a powder compact during consolidation at elevated temperature. This process, hot triaxial compaction (HTC), involves the addition of an axial stress to the powder compact during hot isostatic pressing (HIPing). The resulting shear stress can have three primary effects in materials, which are preferably monolithic powdered compacts: (1) it can increase the density by increasing both the instantaneous (plastic) volumetric strain and the subsequent (viscous) volumetric strain rate, (2) it can impart strain energy leading to interfacial and/or microstructural changes in the product, and (3) it can disrupt heterogeneities and/or aid in their removal, which include powder aggomerates and surface films. The superposition of a shear stress during consolidation can also align and influence the fracture behavior of reinforcing constituents in composites.

SUMMARY OF THE INVENTION

The present invention pertains to an apparatus to compact powder. The apparatus comprises means for hydrostatically stressing the powder. The apparatus is also comprised of means for applying a shear stress to the powder simultaneously with the hydrostatic stress. Additionally, there is means for heating the powder while the powder is stressed hydrostatically and in shear. In the method for compacting powder, there is comprised the steps of applying a hydrostatic stress to the powder. Next, raising the temperature of the powder. Then applying a shear stress to the powder. The presence of the shear stress during the compaction of the powder has three primary effects. It can increase the frame density and/or the densification rate of the compacted powder. It can cause microstructural changes in the compacted powder, and it can disrupt heterogeneities.

BRIEF DESCRIPTION OF THE DRAWINGS

In the accompanying drawings, the preferred embodiments of the invention and preferred methods of practicing the invention are illustrated in which.

DESCRIPTION OF THE PREFERRED EMBODIMENT

Figure 1:
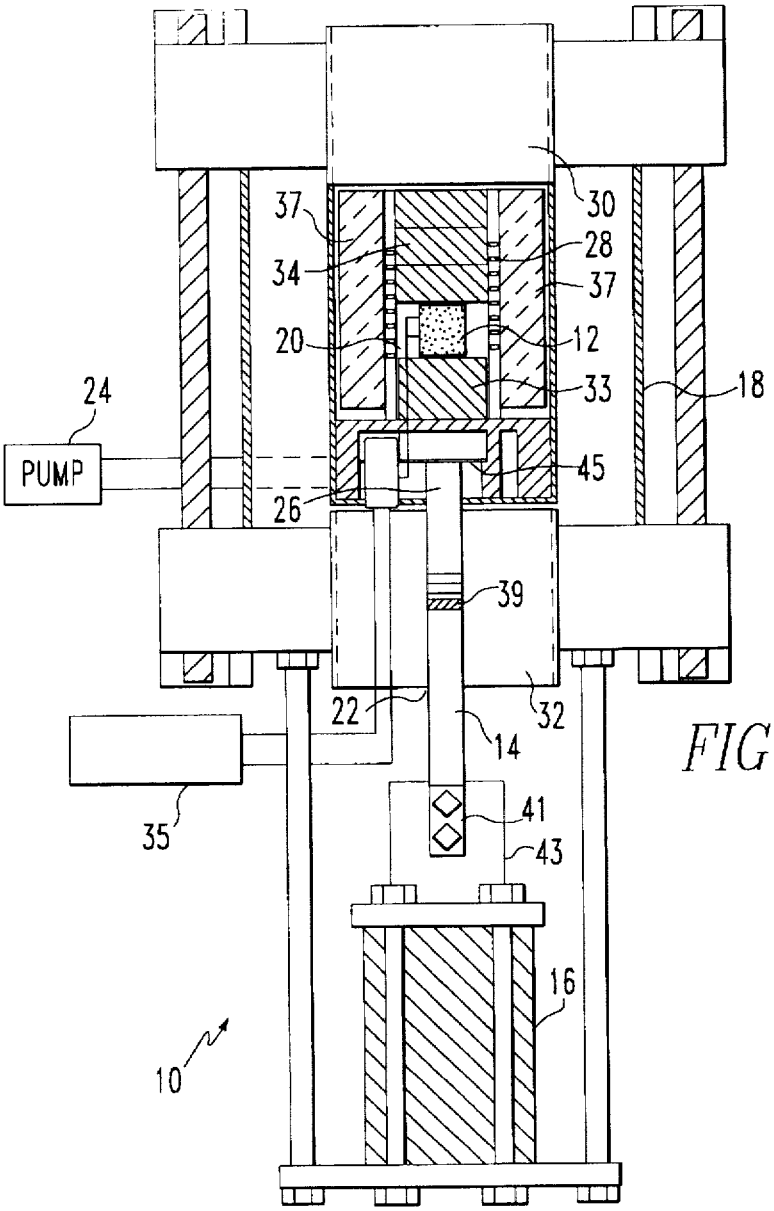
FIG. 1 is a schematic representation of an apparatus to compact powder.

Referring now to the drawings wherein like reference numerals refer to similar or identical parts throughout the several views and more specifically, to FIG. 1 thereof, there is shown a schematic representation of an apparatus 10 to hot triaxially compact powder. The apparatus 10 is comprised of means for hydrostatically stressing the powder 12. The apparatus 10 also includes means for shear stressing the powder 12 simultaneously with the hydrostatic stress. Additionally, the apparatus 10 is comprised of means for heating the powder 12 while the powder 12 is hydrostatically in shear stress.

The shear stressing means preferably includes a ram 14. The shear stressing means also preferably includes means for moving the ram 14 such that the ram 14 applies the shear stress to the powder 12 with an axial force thereto. The shear stress can be, for example, 2000 PSI. Preferably, the moving means includes a hydraulic cylinder 16.

The hydrostatically stressing means preferably includes a pressure vessel 18 with a chamber 20 and a bore hole 22 in communication with the chamber 20. The ram 14 is preferably disposed in the pressure vessel 18 and extends out therefrom through the bore hole 22 to the hydraulic cylinder 16. The hydrostatically stressing means also preferably includes means for providing fluid, for example, a pump 24, to the chamber 20 such that the powder 12 or, for instance, porous compact is hydrostatically stressed by the fluid. The powder can be subject to pressure, for example, 80,000 PSI in the chamber 20. Preferably, the fluid is argon. The ram 14 preferably has a head 26 which is disposed in the chamber 20.

The heating means preferably includes resistance coils 28 positioned in the pressure vessel 18 such that they heat the powder 12 to a desired temperature. Preferably, the resistance coils 28 are molybdenum wire resistance heaters. The temperature can be as high as 1500° C.

The pressure vessel 18 preferably has a load bearing end 30 opposite the end 32 through which the ram 14 extends. The weight bearing end 30 is able to withstand force applied to the ram 14 by the hydraulic cylinder 16. The heating means also preferably includes a first thermal insulation element 33 disposed between the ram head 26 and the powder 12, and a second thermal insulation element 34 disposed between the powder 12 and the weight bearing end 30. Preferably, the first and second thermal insulation elements 33, 34 are zirconia ceramic discs. There can also be fiber insulation 37 in the chamber 20, and a thermocouple 35 to measure temperature.

The powder 12 to be compacted can be prepared a number of ways. For instance, the powder can be cold isostatically pressed to a compact. The compact can then be placed in a tube made of a material preferably softer than the powder 12. The tube is then welded closed about the compact except for a shaft extending radially out from the tube. The compact is then degassed through the shaft. While under a vacuum, the shaft is crimped and welded shut. The compact in the tube is then placed in the chamber 20. Alternatively, the compact without the tube about it can be used. In this instance, the compact should have no positions open to the surface in order for gas to seep into the compact. Sintering of the compact to a high density could accomplish this requirement.

Figure 2:
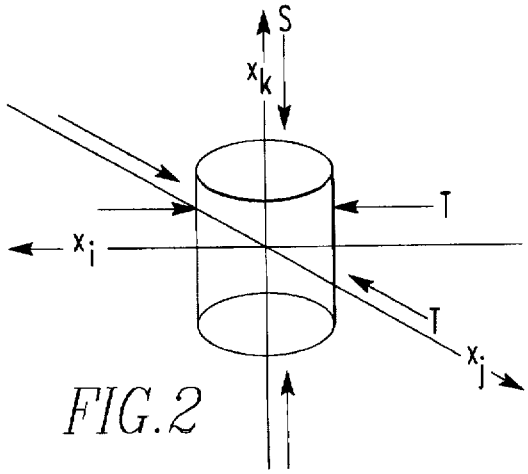
FIG. 2 is a schematic representation of a general axisymmetric triaxial stress state.

When a powder compact is subjected to the most general homogeneous, triaxial stress state, the hydrostatic and deviatoric components of macroscopic stress are $$\sigma_m = \frac{1}{3}\ \sigma ii \tag{3}$$

$$\sigma'_{ij} = \sigma_{ij} - \delta_{ij}\sigma_m \tag{4}$$

respectively. Since all experiments and processes to date involve an axisymmetric stress state, the notation shown in FIG. 2 is adopted where S and T are the applied normal stresses. The confining pressure is equal to T and the additional axial force equal to S–T.

Thus, equations (3,4) become $$\sigma_m = \frac{2T+S}{3} \tag{5}$$

$$\sigma'_{11} = -2\sigma'_{22} = -2\sigma'_{33} = \frac{2}{3}\ (S-T) \tag{6}$$

and the effective stress, defined as $$\bar{\sigma} = \sqrt{\frac{3}{2}\ (\sigma'^2_{11} + \sigma'^2_{22} + \sigma'^2_{33})} \tag{7}$$

becomes $$\bar{\sigma} = (S-T) \tag{8}$$

This stress, $\bar{\sigma}$, is the stress which, absent in HIP, enhances densification in HTC.

Figure 7:
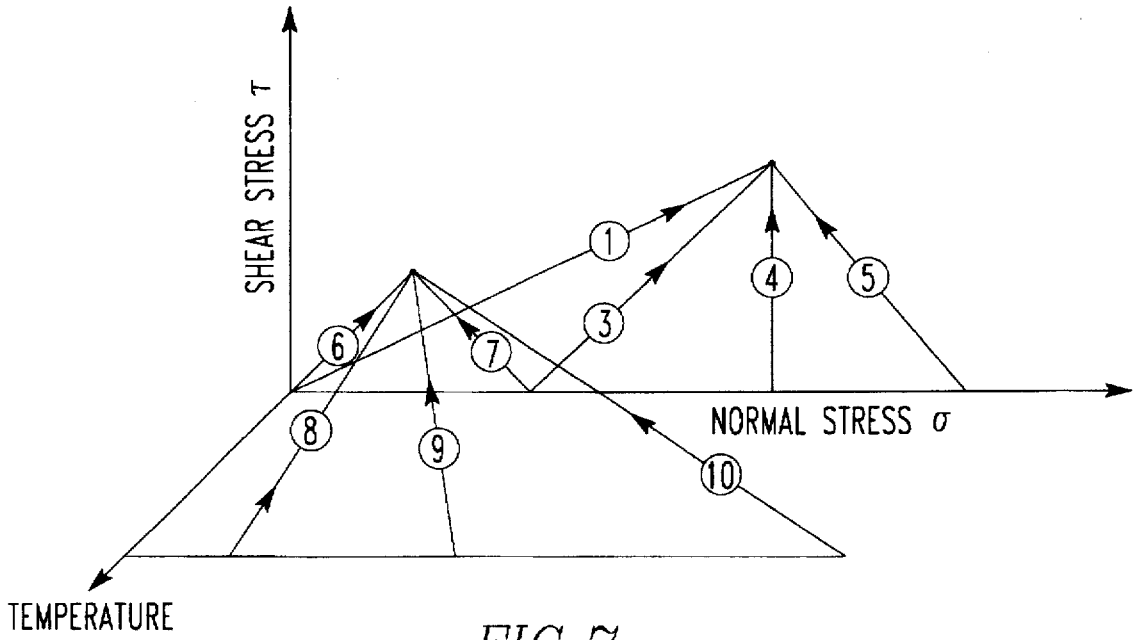
FIG. 7 is a graph of possible triaxial stress/temperature paths in the stress temperature space.

In the method for compacting powder 12, there is comprised the steps of applying a hydrostatic stress to the powder 12. Next, raising the temperature of the powder 12. Then applying a shear stress to the powder. Preferably, the step of applying a shear stress, includes the step of pushing a ram 14 against the powder 12. The step of applying a hydrostatic stress to the powder 12 preferably includes the step of increasing the pressure of a fluid against the powder 12. Furthermore, before the step of applying a hydrostatic stress to the powder 12, there can include the step of compacting the powder 12. The application of the hydrostatic stress, the shear stress, and the temperature rise, can be performed in any order for essentially any length of time depending on the desired results. FIG. 7 shows a graph of examples of various triaxial stress/temperature paths that are obtainable using hot triaxial compaction. Essentially, any path through stress space and temperature space can be achieved.

In the operation of the preferred embodiment, the HTC apparatus 10 is a modified HIP unit. A redesigned lower closure in the 300 MPa, 11.4 cm. (4.5 in.) diameter chamber 20, tie rod pressure vessel 18 allows a ram 14 to move into the hot zone and apply the additional axial stress to the powder 12. Bridgeman type unsupported area pressure seals 39 are utilized. The ram 14 is motivated by a 600 kN force hydraulic cylinder 16. Force is measured via a spindle shaped column 41 set into the adaptor 43 between the hydraulic cylinder 16 and the ram 14. This type of external load cell has the disadvantage of incorporating an unknown seal friction into the load measurement. An internal load cell 45 can also be used to overcome this disadvantage. The axial load is applied after the final pressure is achieved and the differential force is taken to be the applied axial load, thus minimizing the effect of the unknown frictional force. Pressure is measured via bourdon tube dial gages and an electronic transducer (not shown).

Heating is provided by molybdenum wire resistance heaters. In order to accommodate the force transmission and limit thermal conductivity, low conductivity zirconia ceramic discs are inserted between the ram 14 and the powder 12.

Ti-6A1-4V spherical PREP powders, 100–150 μm in diameter, supplied by RMI (Niles, Ohio), were encapsulated in carbon steel (1020) tubes whose ends were both subsequently pinched while under vacuum. No hot degassing was used. The apparatus 10 is then ramped to the predetermined temperature and pressure. All ramp times, pressures, and temperatures were imposed as identically as possible to allow for comparability among samples. The processing schedules for all powders 12 are contained in Table I.

powders, the powder 12 with additional shear or deviatoric stress (the HTCed powder) is nearly fully dense. The HIPed powder shows noticeably higher porosity (99.5% dense). The ramp up pressure profile for each powder 12 was chosen to be as close to the final gas pressure as possible when the final temperature was achieved. This gas pressure for the HTCed powder 12 is less than that for the HIPed powder 12, since a part of the final hydrostatic stress on the HTCed powder 12 is imposed only when the axial load is applied. Thus, one would expect that the HIPed powder 12 was more dense than the HTCed powder 12 at the beginning of the 30 minute hold. Even so, a dramatic increase in density is seen for the HTC process; virtually no pores are visible in the HTCed powder 12.

Figure 5:
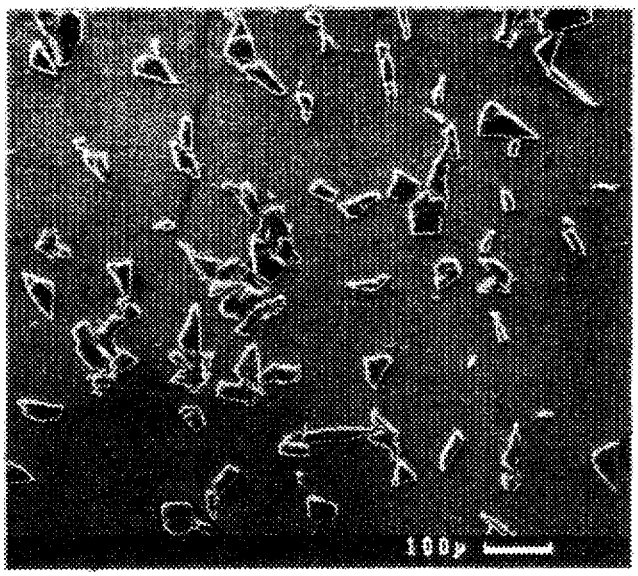
FIG. 5 is a picture of a hot isostatically pressed powder with SiC particulates.
Figure 6:
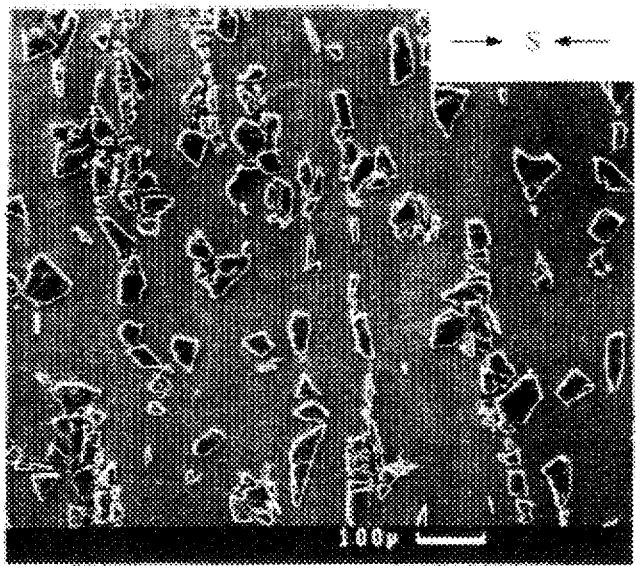
FIG. 6 is a picture of a hot triaxially compacted powder with SiC particulates.

The composites were processed to achieve full density in order to observe any alignment of or damage to the reinforcing phase (SiC). FIG. 5, a scanning electron micrograph of the HIPed composite powder 12 shows no preferential alignment of the SiC particles, while the HTCed powder 12 in FIG. 6 shows a marked vertical alignment of the SiC (the direction of the axial force is horizontal).

Figure 8:
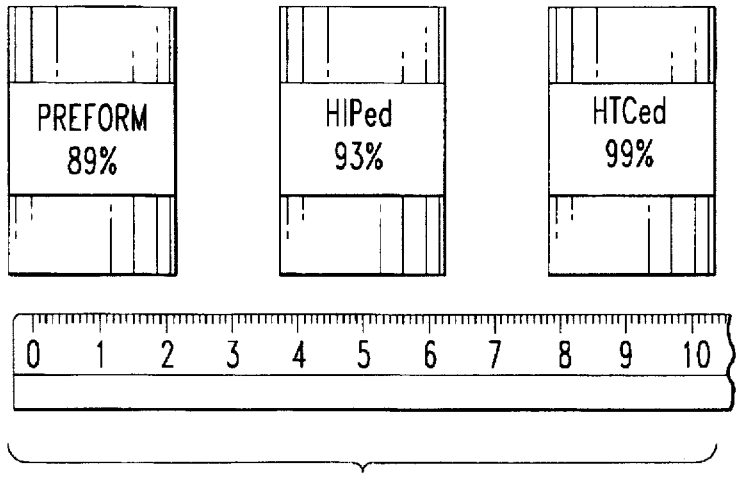
FIG. 8 is a picture of a powder preform, hot isostatically pressed, and hot triaxially compacted aluminum samples.

Table II contains the processing conditions and density results for the aluminum samples shown in FIG. 8.

| | $D_0$ | Temp | Time | T (psi) | S-T (psi) | $\sigma_m$ (psi) | $\bar{\sigma}$ (psi) | $D_1$ |
|---|---|---|---|---|---|---|---|---|
| HIP | .893 | 400° C. | 30 min | 9,200 | 0 | 9,200 | 0 | .930 |
| HTC | .889 | 400° C. | 20 min | 8,500 | 2,100 | 9,200 | 2.100 | .989 |

Thus, the hot triaxial compaction of a powder 12 comprises the step of first compacting the powder 12 with, for instance, die pressing, sintering or cold isostatic pressing. If closed porosity of the compact is utilized, then the compact powder 12 is placed in the apparatus 10 on the zirconia disc on the ram 14. If closed porosity is not used, then the compacted powder 12 is placed in a metal or glass can or tube with a shaft extending out radially therefrom. The can or tube is then evacuated, crimped and welded under vacuum to shut the tube. Then, the compacted powder 12 in the can or tube is placed in the apparatus 10 as is the compacted powder 12 if closed porosity is utilized. Canning can also be accomplished using arc or plasma spraying. Thermal insulation elements 34 are then lowered and the pressure vessel 18 is tightly sealed.

| Specimen | Composition | Time (hr) | Temp (°C.) | T(MPa) | S-T(MPa) | $\sigma_m$ (MPa) | $\bar{\sigma}$ (MPa) | $D_{final}$ (%) |
|---|---|---|---|---|---|---|---|---|
| 1A | Ti-6Al-4V | .5 | 850 | 117 | 0.0 | 117 | 0 | 99.59 |
| 1B | Ti-6Al-4V | .5 | 850 | 89.7 | 169 | 116 | 79.3 | 99.84 |
| 2A | Ti-6Al-4V + −20% SiC | .5 | 850 | 135 | 0.0 | 135 | 0 | 100 |
| 2B | Ti-6Al-4V + −20% SiC | .5 | 850 | 101 | 180 | 128 | 79.3 | 100 |

After compaction, the steel cans are chemically removed and the powder 12 sectioned near the center. All micrographs on all specimens are taken on the longitudinal plane near the center of the compacted powder 12. Typical sections are presented in all of the following figures. Relative density was determined by a simple point count method with an estimated accuracy of ±0.05%. Although powder 1B appears fully dense, any feature which could be very small scale porosity was counted as such, giving the most conservative (lower bound) estimate of the density possible.

Figure 3:
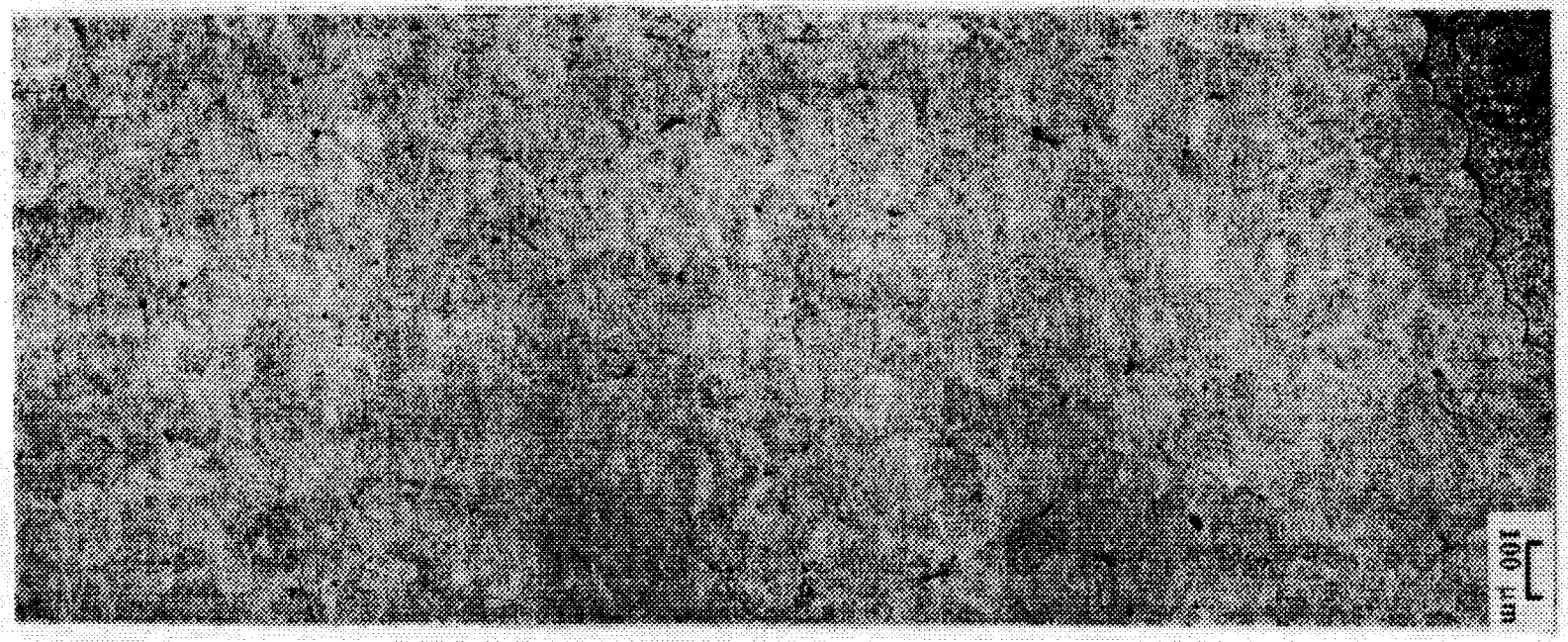
FIG. 3 is a picture of a hot isostatically pressed powder.
Figure 4:
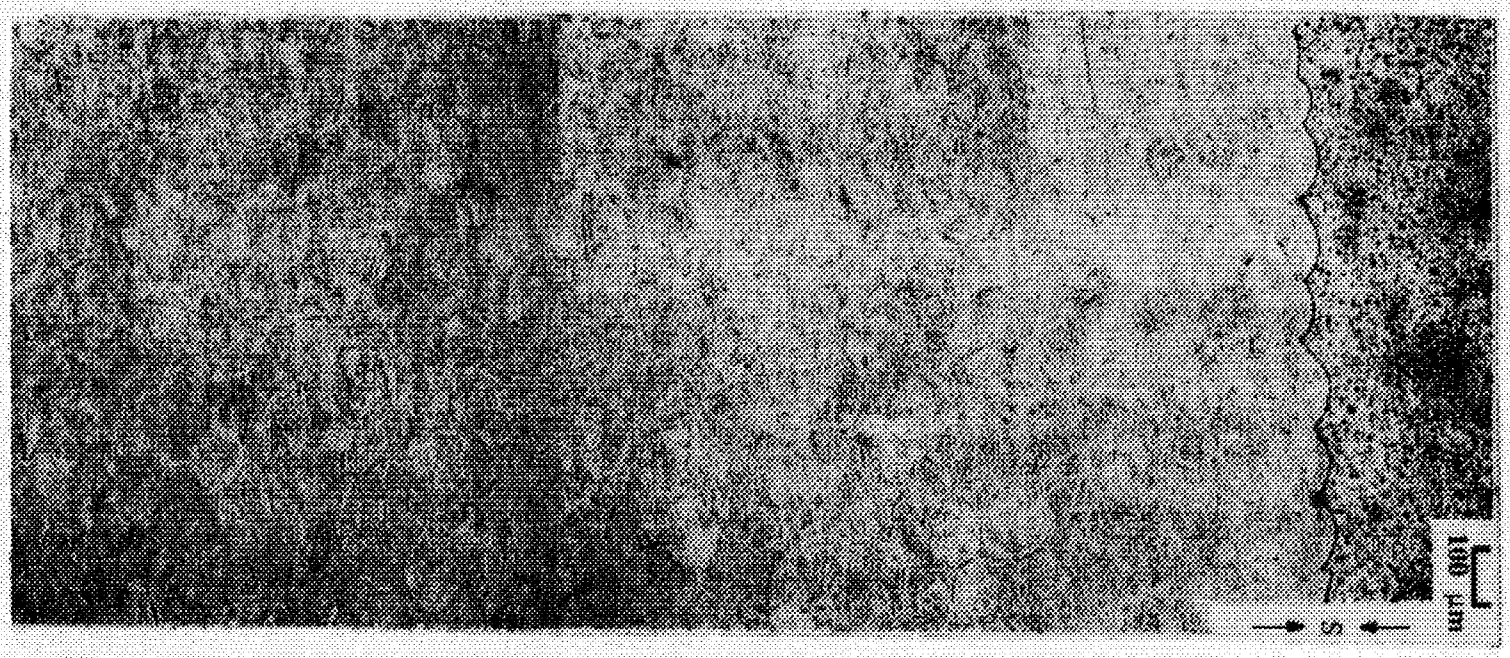
FIG. 4 is a picture of a hot triaxially pressed powder.

FIGS. 3 (HIPed) and 4 (HTCed) show the effect of the absence or presence of shear on densification for the same hydrostatic stress, temperature, and hold time. Though the hydrostatic component of stress is maintained equal for both Hydrostatic stress is then applied to the compacted powder 12 through, for instance, argon gas being pumped into the chamber 20 by pump 24. The same time the temperature in the chamber is increased with the use of the resistance coils 28. Also, shear stress is applied to the compacted powder 12 through the axial force of the ram 14 on the compacted powder 12. Then, after the process is complete, the now hot triaxially compacted powder 12 is removed from the apparatus 10, and if it is in a can or tube, it is removed therefrom.

By controlling the hydrostatic stress, the shear stress and the temperature, various different results can be obtained of the compacted powder 12. For instance, it is possible to consolidate rapidly solidified powders at lower temperatures than heretofore known. This provides for the ability to essentially retain the rapidly solidified type microstructures that are found in traditional processing routes. Additionally, there is the ability to consolidate ultrafine grain metal and ceramic powders at lower temperatures and increased rates, thus preserving a smaller grain size microstructure. There is the ability to consolidate amorphous powders at lower temperatures and/or faster rates preserving the amorphous atomic structure. There is additionally the ability to consolidate mechanically alloyed powders at lower temperatures and faster rates (thus lower times) in order to preserve the microstructural features unique to the mechanically alloyed powders. In addition, there is the ability to introduce mechanical work during consolidation of the powder 12 to generate improved microstructures to obtain better material performance. These are but a few of the advantages that hot triaxial compaction provides.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method for hot triaxially compacting powder comprising the steps of:

orienting a pressure vessel vertically relative to ground, said vessel having a bottom and a top;

placing a powder in the pressure vessel;

sealing the pressure vessel;

applying a hydrostatic stress to the powder by increasing the pressure of a fluid about the powder;

raising the temperature of the powder; and applying a shear stress to the powder through the bottom of the vessel toward the top.

2. A method as described in claim 1 wherein the step of applying a shear stress includes the step of pushing a ram against the powder.

3. A method as described in claim 2 including before the step of applying a hydrostatic stress to the powder, the step of compacting the powder.

* * * * *